US006366539B1

(12) United States Patent
Liao

(10) Patent No.: US 6,366,539 B1
(45) Date of Patent: Apr. 2, 2002

(54) HIGH ILLUMINATION ALARM CLOCK

(76) Inventor: Steven Liao, Room No. 6G14, No. 5, Sec. 5, Hsinyi Rd., Taipei (TW)

( * ) Notice: Subject to any disclaimer, the term of this patent is extended or adjusted under 35 U.S.C. 154(b) by 0 days.

(21) Appl. No.: 09/565,467

(22) Filed: May 5, 2000

(51) Int. Cl.[7] ..... G04B 19/30
(52) U.S. Cl. ..... 368/227; 368/67
(58) Field of Search ..... 368/227, 228, 368/67

(56) References Cited

U.S. PATENT DOCUMENTS 3,574,993 A * 4/1971 Black ..... 368/227

* cited by examiner

*Primary Examiner*—Bernard Roskoski
(74) *Attorney, Agent, or Firm*—Rosenberg, Klein & Lee

(57) ABSTRACT

An alarm clock comprises a seat, a switch, a light emitter, a light guiding plate, a light shielding layer, a timer, a transparent mask, a frame, and a power source. The timer is installed in the seat and drives a rotary shaft to pass out through the light shielding layer and the light guiding plate to be connected to indicators. The surface of the light guiding plate is arranged with scales and numeral indicators. A frame is fixed at a periphery of the seat, and after the light guiding plate and the light shielding layer are positioned, a transparent mask is connected to the inner side of the frame. The seat supports a light emitter and a light emitter switch which are connected with one another. The switch is connected to a power source. Pressing the lateral side of the transparent mask operates the light emitter switch. The light emitter will be energized and thus light up, so that the light from the light emitter passes through a light guide seat of the light guiding plate to all the indicators on the light guiding plate. The light shielding layer provides a higher illumination to all the indicators so that time indicators on the panel can be easily seen.

7 Claims, 8 Drawing Sheets

HIGH ILLUMINATION ALARM CLOCK

BACKGROUND OF THE INVENTION

1. Field of the Invention

The present invention relates to an alarm clock, and particularly to an alarm clock structure where the scales on the clock panel will generate an illuminated state.

2. Prior Art

A prior art alarm clock invented by the applicant is shown in FIGS. 6 to 8. The prior art alarm clock has a seat 10, a substrate 20, an opaque panel 25, a cover 28, and a light emitter 16. A frame 15 is installed at the front side of the fluorescent indicators 24 on the seat 10. The frame 15 serves to fix the opaque panel 25 and the transparent mask 28. A light emitter 16 is installed at a proper position in the inner edge at one side of the frame 15, and a timer 11 s installed within the seat 10. A rotary shaft 12 of the timer 11 passes through the central hole 26 of the opaque panel 25, then, the rotary shaft 12 drives the indicators 18 and 19 to rotate. A time setting indicator 29 is further installed for cooperating with the pressing piece 13 of the alarm clock, so as to complete a basic structure of an alarm clock. The power source of the timer 11 is connected to a battery 17. A positioning post 14, is installed within the seat 10 for positioning the circuit board 20. Two connections 21 and 22 are provided on the circuit board 20. As the connections 21 and 22 contact a conducting piece 23, the circuit is closed. The first connection 21 is coupled to one electrode of the battery 17 through an electric wire. The second connection 22 is connected to one pin of the light emitter 16. Another pin of the light emitter 16 may be connected to another electrode of the battery 17 through an electric wire. Thereby, when the conducting piece 23 on the circuit board 20 contacts the connections 21 and 22, the two connections on the circuit board 20 will conduct and the light emitter 16 is illuminated to display the scales. However, in the prior art, the right side of the cover 28 must be pressed for actuating the light emitter 16, i.e., the conducting piece 23 is pressed by pressing the right side of the cover. The light from the light emitter 16 only illuminates the right half of the cover 28. In the dark, the light from emitter 16 only causes the numerals on the right half of the panel of the clock to be clearly visible, while those on the left half remain in the dark. Moreover, the light impinging on the indicators 18 and 19 is insufficient and thus, they cannot be seen rapidly. Therefore, a longer pressing action to maintain the illumination is required to clearly see the indicators.

SUMMARY OF THE INVENTION

Accordingly, the primary object of the present invention is to provide an alarm clock, wherein a special structure is used to guide light into a light guiding plate. The symbols and numerals being indicators of the light guiding plate carrying fluorescent material, they will light up as the light emitter lights up. Thus, all the indicators will be clearly seen, instead of the condition where half of the indicators are illuminated and the other half are dark, as that in the prior art. The present invention provides a uniform light distribution. Light is emitted across the whole face, instead of lighting up a single point. In the present invention, the visibility of the indicators on the panel of a clock is greatly improved. Therefore, the time scale can be seen conveniently, simply and rapidly. In the dark, the right side of the frame is pressed, the light guiding plate is illuminated and the time scale can then be clearly read.

In order to achieve the aforesaid objects, an alarm clock is provided that comprises a seat, a switch, a light emitter, a light guiding plate, a light shielding layer, a timer, a transparent mask, a frame, and a power source. The timer is installed in the seat and drives a rotary shaft to pass out from the light shielding layer and the light guiding plate to be connected to the indicators. The surface of the light guiding plate is arranged with scales and numeral indicators. A frame is fixed at a periphery of the seat, and after the light guiding plate and the light shielding layer are positioned (light shielding plate or a white paint layer), a transparent mask is connected to the inner side of the frame. The seat supports a light emitter and a light emitter switch which are connected with one another. The switch s connected to a power source. Pressing the lateral side of the transparent mask to press the light emitter switch, the light emitter will be energized and thus light up, so that the light from the light emitter passes through a light guide seat of the light guiding plate to all of the indicators with fluorescent material located on the light guiding plate. By use of the light shielding layer, a higher illumination of all the indicators is generated so that the time indicators on the panel can be seen easily.

The various objects and advantages of the present invention will be more readily understood from the following detailed description when read in conjunction with the appended drawings.

DETAILED DESCRIPTION OF THE PREFERRED EMBODIMENTS

Figure 1:
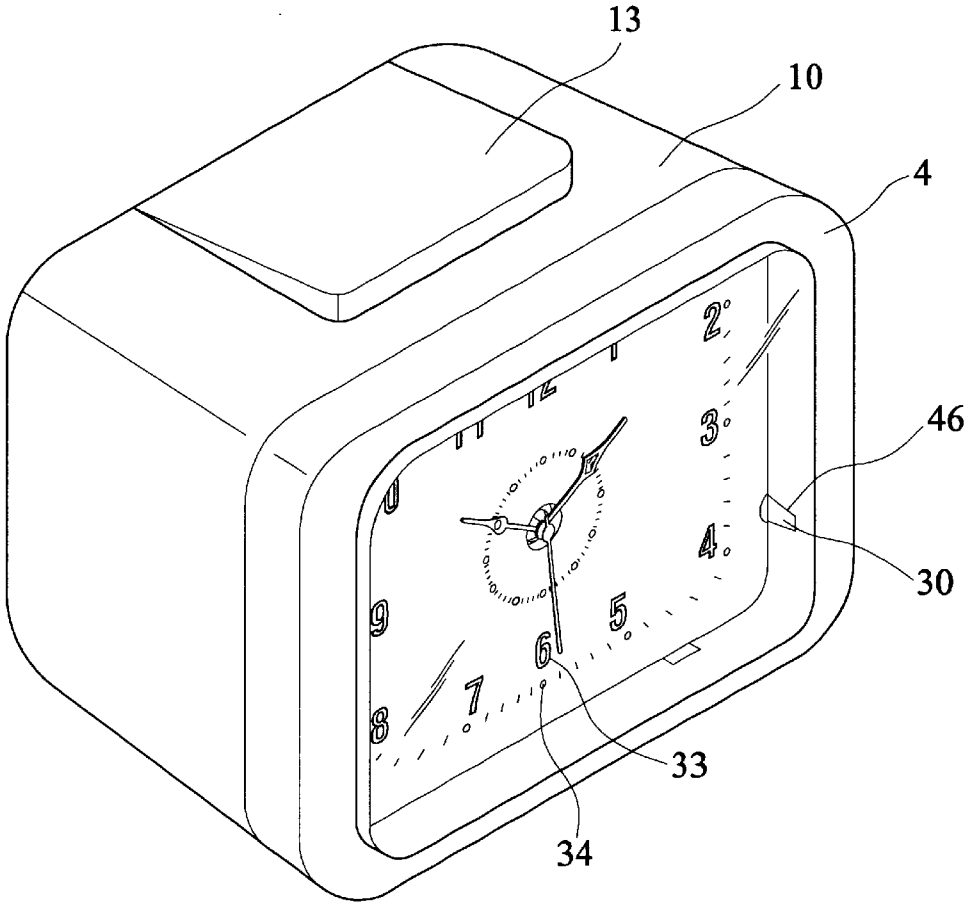
FIG. 1 is a perspective view of the present invention.
Figure 2:
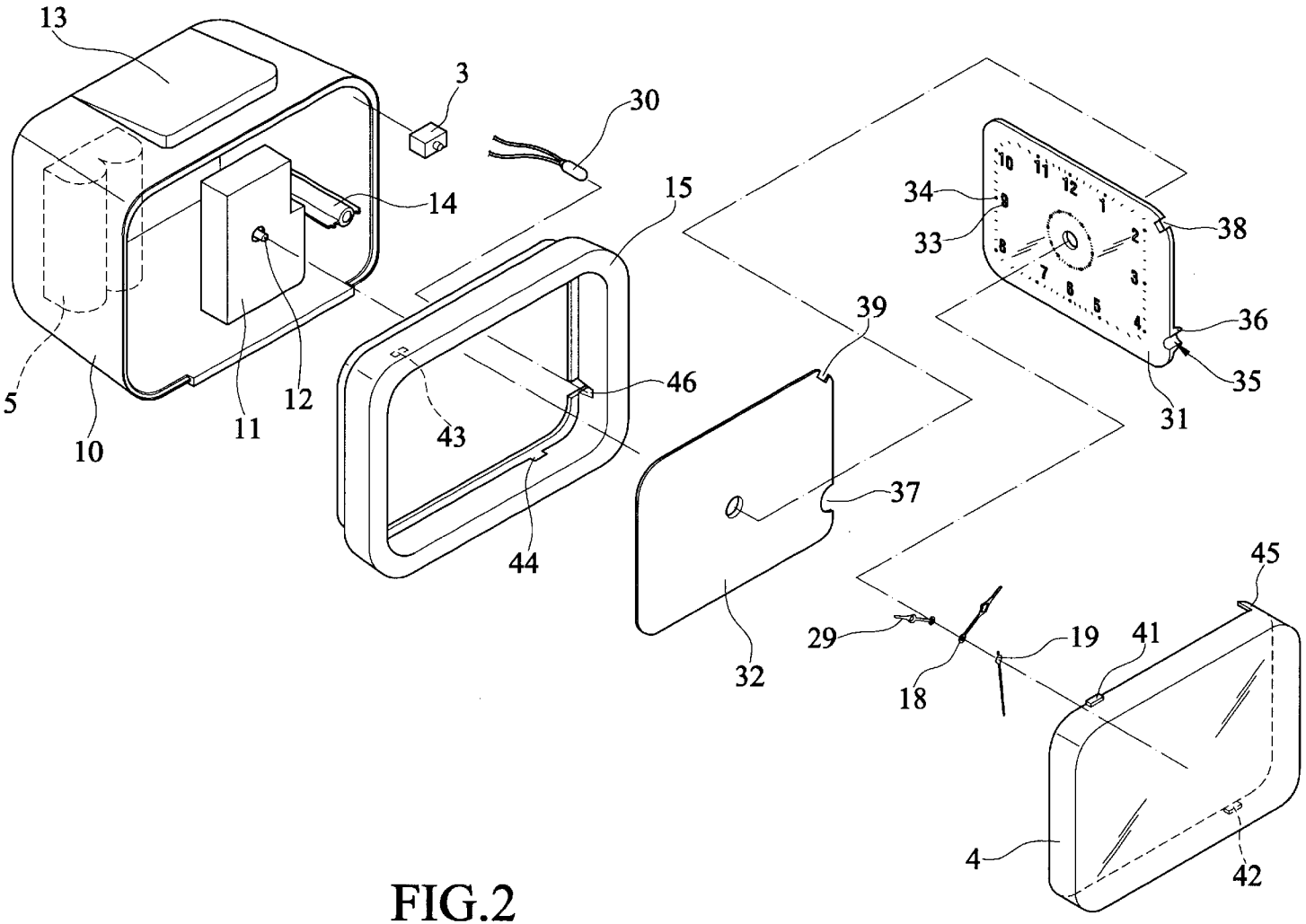
FIG. 2 is an exploded perspective view of the present invention.

With reference to FIGS. 1 to 5, an alarm clock according to the present invention is illustrated herein. The alarm clock includes a seat 10, a switch 3, a light emitter 30, a light guiding plate 31, a light shielding layer 32 (including a light shielding plate and a white paint layer 47 having the function of shielding and reflecting), a timer 11, a transparent mask 4, a frame 15, and a power source 5. The timer 11 is installed in the seat 10 and is a necessary component. A pressing piece 13 is installed on the seat 10 for switching the alarm clock. In general, an alarm clock has a battery as a power source and is formed with rotary indicators. Since timer 11 is used in the prior art, the components therein will not be described again. The timer 11 drives a rotary shaft 12 that passes out from the overlapped central holes of the light shielding layer 32 and the light guiding plate 31, to be connected to the indicators 18 and 19. The surface of the light guiding plate 31 is arranged with scales 34 in equally spaced relationship and equally spaced numeral indicators 33. The scales 34 represent minutes. The numeral indicators are hour indicators. This is a general representation of the panel of the clock.

One side of the seat 10 supports a light emitter 30 by a positioning post 14 and a light emitter switch 3, in the light emitter 30 or other proper place. The switch 3 is a pressable element for providing electric conduction therethrough. In the figure, the position of the switch 3 is at the upper right corner of the seat 10 for matching with the lower right indicator 30 of the seat 10. After assembling the light shielding layer 32 and the light guiding plate 31, the indicators 18 and 19 and the timing indicator 29 are mounted. Then, the frame 15 is fixed to the periphery of the sat 10. After the light guiding plate 31 and the light shielding layer 32 are positioned at the lower surface of the frame 15, the transparent mask 4 is installed to cover the inner side of the frame 15, so that the periphery of the transparent mask 4 presses n the surface of the light guiding plate 31. The peripheral portion of the transparent mask 4 has protrusions 41 and 42 at the left upper corner and right lower corner, respectively, which are buckled at the fixing grooves 43 and 44 of the frame 15, so as to function as fulcrums for rotation. A strip 45 extends from the upper right of the transparent mask 4 to make contact with the switch 3. As the right lateral side of the light emitter 30 of the transparent mask 4 is pressed, the tilted transparent mask 4 will cause the power source 5 of the light emitter 30 to conduct, and thus, light up the light emitter 30. The light of the light emitter 30 is transmitted through a light guide seat 36 adjacent one corner 35 of the light guiding plate 31. The light is guided to the scale 34 and the numerals 33, with fluorescent material, so as to generate a higher illumination. Thus, the time indication can be easily seen. A groove 37 is formed in the light shielding layer 32 at a position corresponding tot he light guide seat 36. A hole 38 is formed on the upper right portion of the light guiding plate 31. A further hole 39 is formed at a position corresponding to the upper right portion of the light shielding layer 32 so as to receive the strip 45. A portion of the light emitter 30 is received in the frame 15. The light emitter 30 can be a light emitting diode (LED), and the light guide groove 46 is formed in the frame 15 adjacent the light emitter 30 for guiding and emitting a portion of the light. The whole structure of the present invention is described hereinabove. The power source 5 may be a battery, or an alternating current power source.

Figure 3:
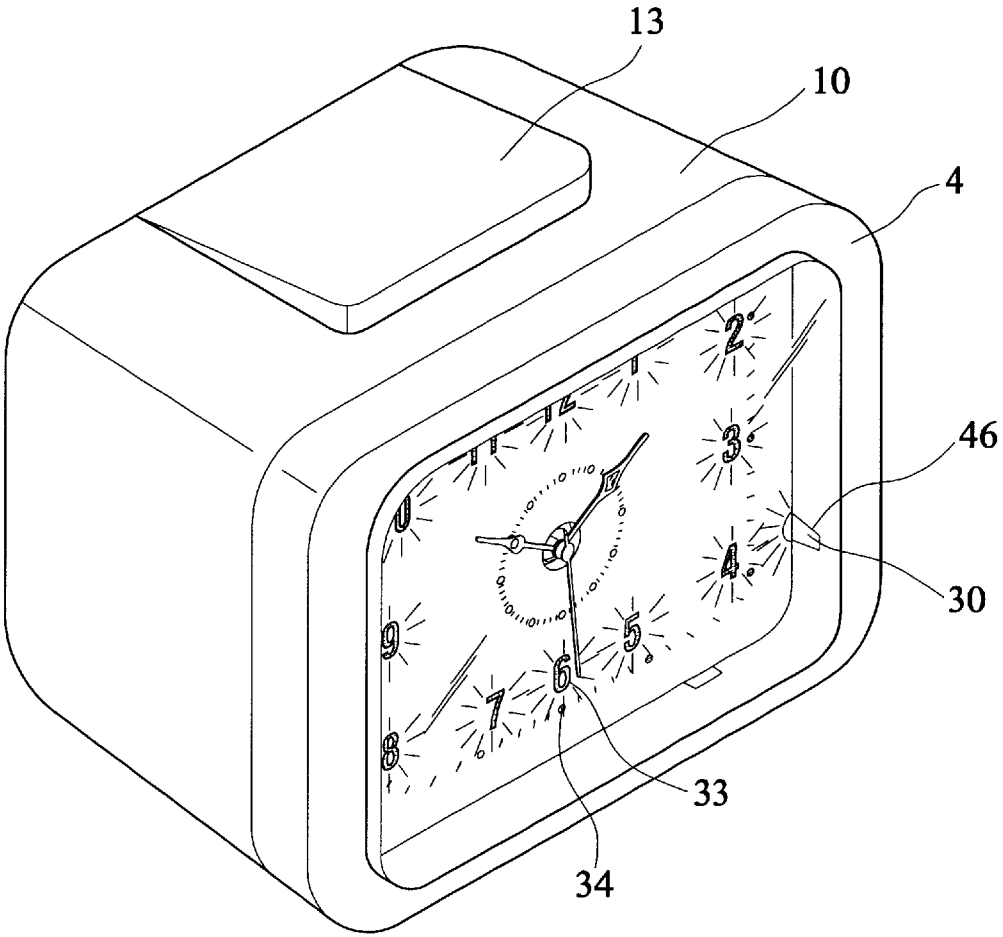
FIG. 3 is a perspective view showing the embodiment of the present invention (showing a light up condition).
Figure 4:
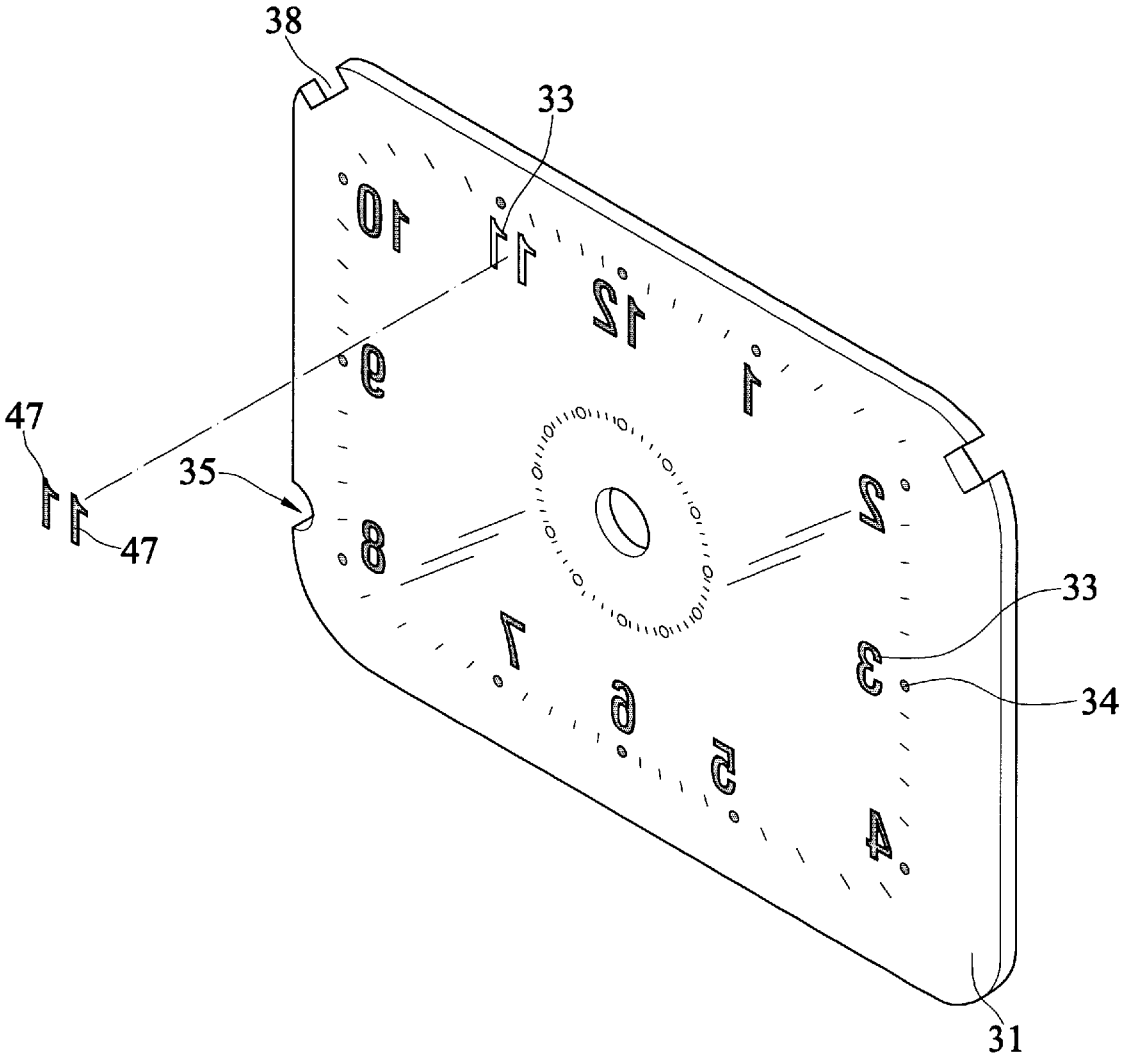
FIG. 4 is a rear perspective view showing another embodiment of the light guiding plate in the present invention.
Figure 5:
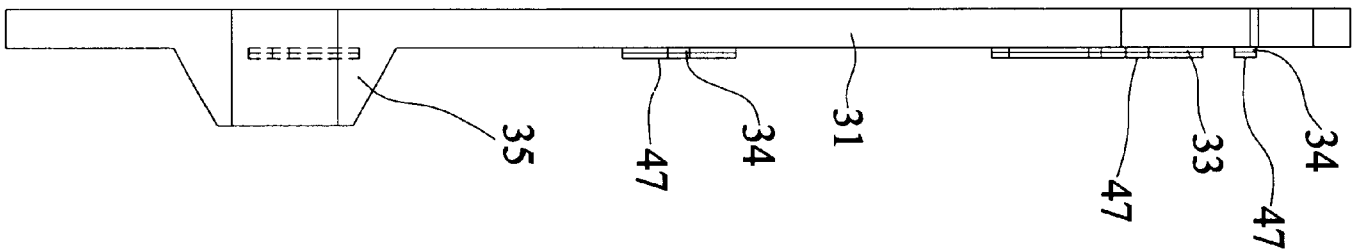
FIG. 5 is a lateral view of the light guiding plate of the present invention.
Figure 6:
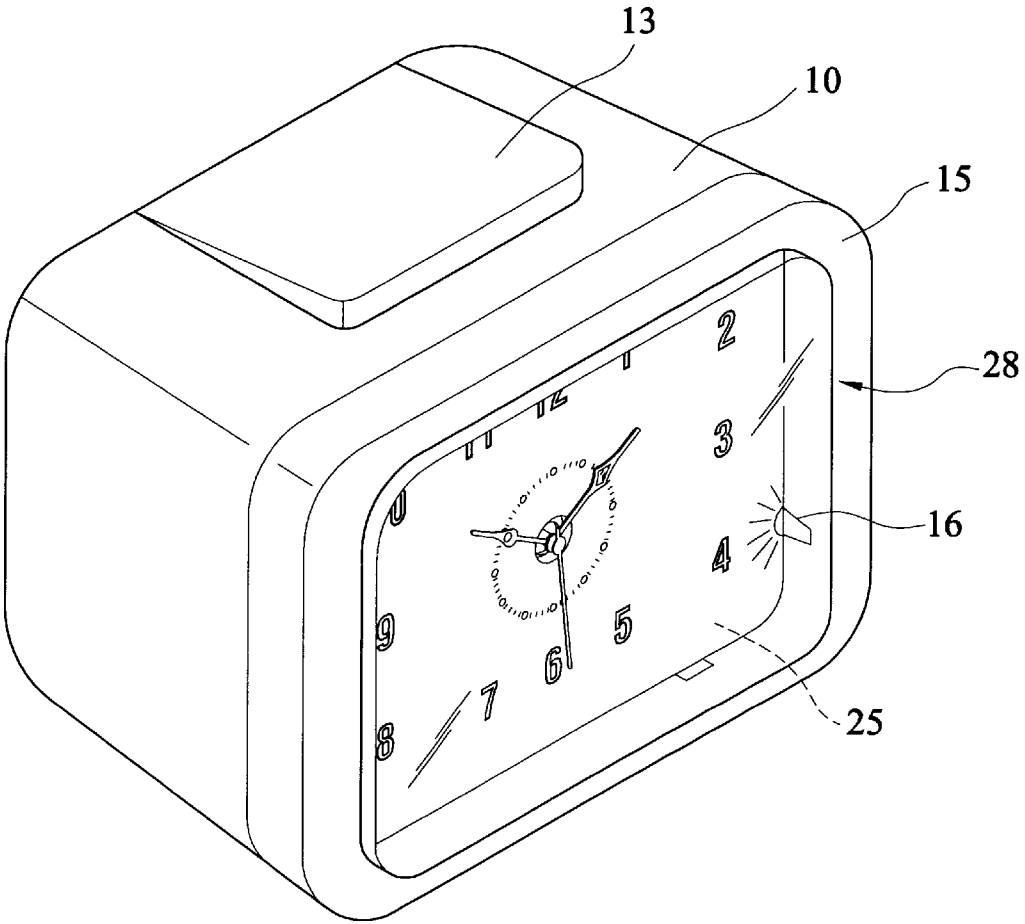
FIG.6 PRIOR ART
FIG. 6 is a perspective view of a prior art.
Figure 7:
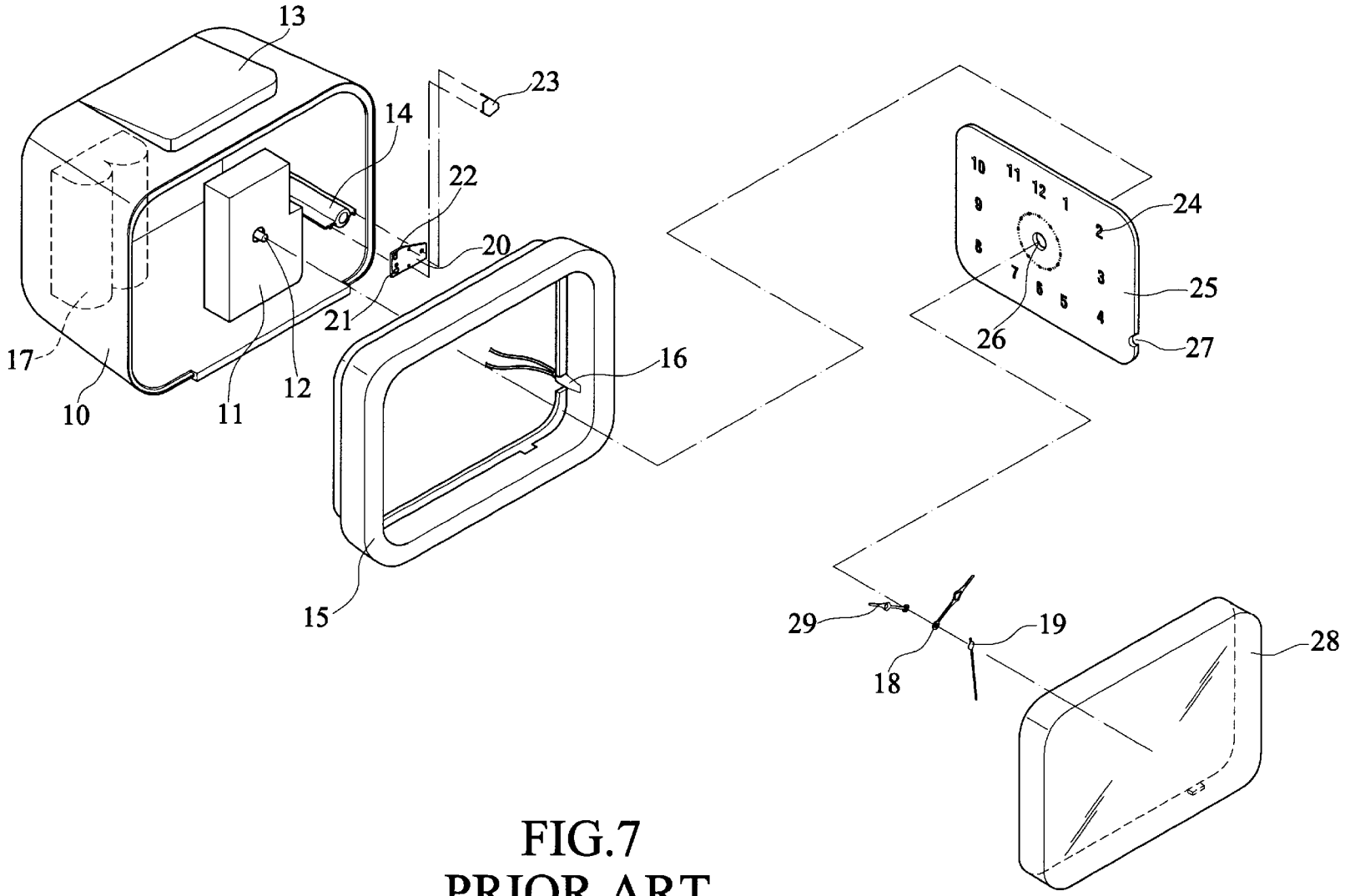
FIG.7 PRIOR ART
FIG. 7 is an exploded perspective view of a prior art.
Figure 8:
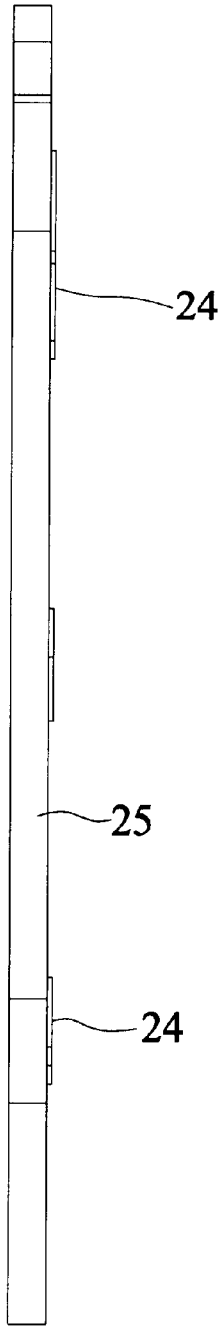
FIG.8 PRIOR ART
FIG. 8 is a lateral view of a non-light sensitive panel of a prior art.

In summary, a primary feature of the present invention is that by the light guide seat 36 of the light guiding plate 31, light is guided into the light guiding plate 31. Since the light guiding plate 31 is transparent, it is a preferred light guide, so that light can be rapidly guided to each of the indicators 33, 34. Since all indicators are impinged by the light, the indicators made with fluorescent material will emit fluorescent light. Similarly, the light shielding layer 32 can be a thin light shielding plate, or a white paint layer 47 that has the functions of light shielding and reflection. As shown in FIGS. 4 and 5, a light shielding white paint layer 47 serves to replace the light shielding plate. The paint of the white paint layer 47 covers the inner surfaces of the indicators 33 or 34, to provide direct reflection. If it is desired to enhance the effect, after the white paint is coated on the indicators with fluorescent material, a light shielding plate can be installed. Thus, at a non-emitting light status, as shown in FIG. 1, if the switch is pressed, the state of the light display, shown in FIG. 3, is achieved. Furthermore, since the light guiding plate 31 is made of a transparent material, it will further generate a similar light emitting effect. Therefore, the whole panel of the clock will light up, especially the indicators. This is because, in the present invention, a light shielding layer 32 is arranged at the rear side of the light guiding plate 31, and thus, the light is distributed uniformly to increase the light of the panel. In order to increase the uniformity of the illumination, the white paint layer and the light shielding layer 32 are necessary for achieving the required effect. The light guide groove 46 of frame 15 also emits part of the light to the surface of the light guide plate 31, to drive the indicators to light up again and the fluorescent indicators to luminesce. Therefore, an illumination effect different from the prior art fluorescent structure or prior art side lamp structure is achieved. In the present invention, all the indicators are illuminated, and this is better than the prior art where only one side is illuminated, while the other side is dark. The indicators on the panel can be seen rapidly in the present invention, which is completely different from the prior art designs.

Although the present invention has been described with reference to preferred embodiments, it will be understood that the invention is not limited to the details described therefore. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An alarm clock comprising a seat, a light guiding plate, a light shielding layer, a timer, at least a pair of time indicators, a transparent mask, a frame, a power source, a light emitter switch connected to the power source, and a light emitter connected between the switch, wherein the timer is installed in the seat and drives a rotary shaft that passes out through an opening in the light shielding layer and a corresponding opening in the light guiding plate and connected to the pair of time indicators; the light guiding plate overlaying the light shielding layer having a surface arranged with scales and numeral indicators thereon; the frame being fixed at a periphery of the seat, and a transparent mask is connected to an inner side of the frame; the seat providing support for the light emitter and the light emitter switch which are connected with one another; the light guiding plate having a light guide seat formed therein disposed adjacent the light emitter; the transparent mask being adapted to be pressed on a lateral side thereof for operating the light emitter switch and energizing the light emitter to illuminate, a portion of the light from the light emitter passing through the light guide seat of the light guiding plate to the numeral indicators disposed on the light guiding plate and having fluorescent material thereon, and the light shielding layer providing higher illumination for easier visualization of the time indicators on the light guiding plate.

2. The alarm clock as claimed in claim 1, wherein a periphery of the transparent mask has a pair of protrusions secured to a pair of fixing grooves formed in the frame and adapted to function as fulcrums for displacement of the lateral side the transparent mask to operate the light emitter switch, the transparent mask having a strip extending therefrom for contacting the light emitter switch responsive to the transparent mask being pressed.

3. The alarm clock as claimed in claim 1, wherein the frame has a light guide groove formed therein, at least a portion of the light emitter passing into the light guide groove for guiding a portion of the light from the light emitter.

4. The alarm clock as claimed in claim 1, wherein the light shielding layer is defined by a light shielding plate and disposed adjacent a back surface of the light guiding plate.

5. The alarm clock as claimed in claim 1, wherein the light shielding layer is defined by a white paint layer applied directly to a back surface of the numeral indicators.

6. The alarm clock as claimed in claim 5, wherein in the light shielding layer further includes a light shielding plate disposed adjacent a rear surface of the light guiding plate, the light shielding plate having a layer of white paint thereon.

7. The alarm clock as claimed in claim 1, wherein the light guiding plate is transparent.

* * * * *